US006098710A

United States Patent [19]

Rhein-Knudsen et al.

[11] Patent Number: 6,098,710

[45] Date of Patent: Aug. 8, 2000

[54] METHOD AND APPARATUS FOR CEMENTING A WELL

[75] Inventors: Erik Rhein-Knudsen; Claude J. Vercaemer, both of Houston, Tex.; Laurent P. Prouvost, Bures sur Yvette; Arthur W. Milne, Noisy le Roi, both of France; Jean-Louis Pessin, Houston, Tex.

[73] Assignee: Schlumberger Technology Corporation, Sugar Land, Tex.

[21] Appl. No.: 08/960,513

[22] Filed: Oct. 29, 1997

[51] Int. Cl.[7] ..... E21B 33/14; E21B 34/12

[52] U.S. Cl. ..... 166/285; 166/242.1; 166/332.4; 166/386

[58] Field of Search ..... 166/285, 382, 166/386, 242.1, 334.4, 332.4, 208, 51, 278

[56] References Cited

U.S. PATENT DOCUMENTS

| | | | |
|---|---|---|---|
| 4,044,832 | 8/1977 | Richard et al. | 166/278 |
| 4,619,326 | 10/1986 | van Mierlo . | |
| 4,976,322 | 12/1990 | Abdrakhmanov et al. . | |
| 5,083,608 | 1/1992 | Abdrakhmanov et al. . | |
| 5,119,661 | 6/1992 | Abdrakhmanov et al. . | |
| 5,348,095 | 9/1994 | Worrell et al. . | |
| 5,641,021 | 6/1997 | Murray et al. . | |

FOREIGN PATENT DOCUMENTS 1056396 1/1967 United Kingdom .

OTHER PUBLICATIONS

Barker, J.W. (Mar. 1997). Wellbore Design With Reduced Clearance Between Casing Strings. *Society of Petroleum Engineers*SPE/IADC 37615, 341–349.

Rothermund, Heinz, Shell Expro Managing Director, Shell U.K. Exploration and Production. "Accelerating the Application of New Well Technology." Brochure produced by Publications and Cartography Services, UEPS/21 (Jun. 1996).

Rothermund, Heinz, Shell Expro Managing Director, Shell U.K. Exploration and Production. "The Challenge of Drilling in the New Millenium." Brochure produced by Publications and Cartography Services UEPS/2 (Sep. 1996).

*Primary Examiner*—George Suchfield
*Attorney, Agent, or Firm*—Gordon G. Waggett; Robin C. Nava

[57] ABSTRACT

In one embodiment, the invention relates to a method or process, useful in cementing a well, especially a hydrocarbon well, which is characterized by the use of increased external and internal diameter liners, the method being characterized by provision and use of a novel liner and liner-tool assembly. Novel liner apparatus, a liner-tool assembly, and a fluid circulating tool are also disclosed.

30 Claims, 3 Drawing Sheets

FIG. 1
(PRIOR ART)
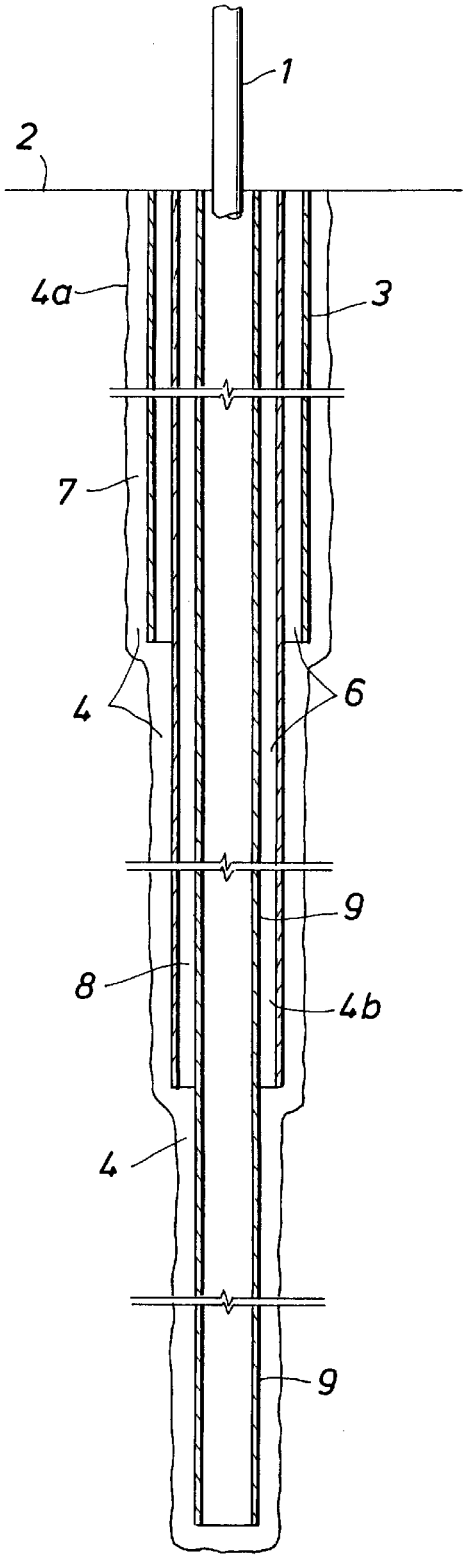
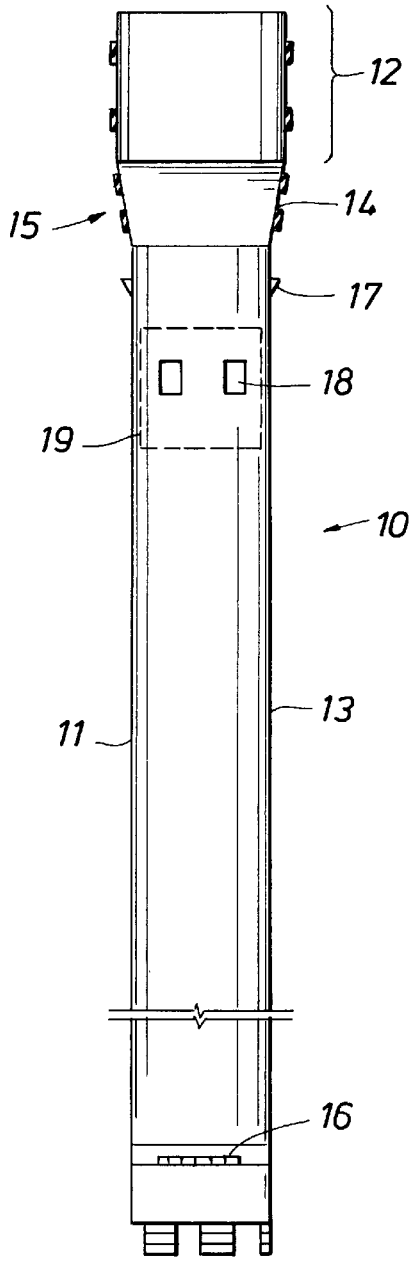
FIG. 2

METHOD AND APPARATUS FOR CEMENTING A WELL

FIELD OF THE INVENTION

This invention relates to a method for cementing a well and to apparatus useful in well cementing operations.

BACKGROUND OF THE INVENTION

In the conventional drilling of a well, such as an oil well, a series of casings and/or liners are commonly installed sequentially in the wellbore or borehole. In standard practice, each succeeding liner placed in the well-bore has an outside diameter significantly reduced in size when compared to the casing or liner previously installed. Commonly, after the installation of each casing or liner, cement slurry is pumped downhole and back up into the space or annulus between the casing or liner and the wall of the wellbore, in an amount sufficient to fill the space. The cement slurry, upon setting, stabilizes the casing or liner in the wellbore, prevents fluid exchange between or among formation layers through which the wellbore passes, and prevents gas from rising up the wellbore.

The use of a series of liners which have sequentially reduced diameters is derived from long experience and is aimed at avoiding problems at the time of insertion of casing or liner installation in the wellbore. The number of liners or casings required to reach a given target location is determined principally by the properties of the formations penetrated and by the pressures of the fluids contained in the formations. If the driller encounters an extended series of high pressure/low pressure configurations, the number of liners required under such circumstances may be such that the well cannot usefully be completed because of the continued reduction of the liner diameters required. Again, a further problem of the standard well liner configuration is that large volumes of cuttings are produced initially, and heavy logistics are required during early phases of drilling.

The present invention is directed to a well lining and cementing technique or procedure, and means to carry it out, which would eliminate or significantly reduce the degree of diameter reduction required when a series of well liners must be inserted.

SUMMARY OF THE INVENTION

There is thus provided, in one embodiment, a method or process, useful in cementing a well, especially a hydrocarbon well, which is characterized by the use of increased external and internal diameter liners, i.e., by a reduction in the degree of diameter reduction of the liners required, and which does not require excessively large initial conductor casing or surface pipe. Accordingly, in this embodiment, the invention relates to a method of cementing a wellbore in which a casing or first liner is provided in a wellbore. As utilized herein, the terms "first" and "second", etc., in relation to the casing or liners mentioned, are relative, it being understood that, after the initial "second" casing or liner is cemented, it may become a "first' liner for the next cementing operation as such operations proceed down the wellbore. Moreover, the "first" liner may actually be at a location down well if previous liner techniques have been utilized in "upper" liner sections. Regardless, the bottom end of the casing or a designated "first" liner is provided with or terminates in a specially shaped joining section (or joint) of somewhat reduced or decreased internal diameter (compared to the normal internal diameter of the casing) adapted to stabilize and/or provide support for an additional section of liner, as described more fully hereinafter.

Further drilling operations are then conducted, preferably after cementing the casing or first liner, to provide an enlarged wellbore. As used herein, the term "enlarged wellbore" refers to a wellbore or borehole having a diameter greater than that of the normal internal diameter of the casing or preceding liner, preferably greater than the largest external diameter of the casing or preceding liner, such a wellbore being provided or drilled in a manner known to those skilled in the art, as also described more fully hereinafter. At a desired depth, or when it is otherwise decided to line and cement the enlarged wellbore, there is provided in the casing or liner a liner-tool assembly which comprises a wellbore liner, having at least one port for wellbore fluid flow, and a novel fluid circulating tool disposed in the liner. The liner-tool assembly is adapted to provide a first fluid flow path for transmission of a fluid through the fluid circulating tool and the liner and into a wellbore, and a second separate fluid flow path for transmitting fluid received from exterior or outside the liner through the port or ports and through the fluid circulating tool in a direction opposite that of the first flow path. For simplicity, as used hereinafter, except where inconsistent with clearly intended meaning, e.g., in describing specific embodiments where a plurality of ports is illustrated, the term "ports", will be understood to include a single port, the requirement of the invention being simply that sufficient flow opening or aperture be provided, although a plurality of openings is preferred. Preferably, the greatest external (outside) diameter of the liner or second liner of the liner-tool assembly approximates, i.e., is only slightly smaller, than the normal or smallest internal diameter of the casing or first liner provided. In a preferred embodiment, the liner or second novel liner comprises a minor section or segment whose outside diameter may closely approximate the normal internal diameter of the previous casing or liner and a major portion or section having an external diameter which approximates that of the joining section or segment. The minor and major sections of the liner are joined or coupled in suitable manner, communicating preferably through a tapering section, and the liner portion or junction where they join is preferably of unitary or integral construction. The size differential between the segments permits provision of the length of the major section of the liner through the aforementioned bottom joining section and into the wellbore while retaining the minor section in the previous casing or liner in or above the bottom joining section or segment.

According to the invention, therefore, the liner-tool assembly is then positioned in the wellbore so that the ports are positioned proximate and beneath the casing in the enlarged wellbore. In the case of the preferred embodiment, the liner or second liner is positioned in relation to the enlarged wellbore, with the ports placed as mentioned, so that the minor section or segment is located or positioned in the lower portion of the casing or first liner and in such manner that the weight of the second liner may be supported by the upper or first casing or liner.

To position the liner or second liner, as described, there is disposed or provided on the drillstring or tool, as part of the liner-tool assembly mentioned, inside the bore of the liner or second liner, as more fully described hereinafter, a movable, fluid circulating tool of appropriate dimensions, preferably positioned in said liner distant from the bottom of the major segment and disposed or partly disposed in the major and minor sections or segments, and which, after initial positioning or installation by the string, is fixed thereby in relation to the wellbore. The fluid circulating tool comprises a member appropriately sized and adapted or shaped to allow a separate or first fluid flow path or passage(s) for transmission of a fluid or fluids through a liner into a wellbore and, in conjunction with ports and means provided, a second fluid or flow path or passage(s) for transmission of wellbore fluid in a direction opposite that of the first fluid flow path. The invention thus provides flow without substantial or significant impediment from the annulus formed by the liner and the enlarged wellbore to the interior or bore of the casing or first liner, and up the well. The novel fluid circulating tool may further comprise or contain appropriate sealing means on the member for preventing significant passage of fluid past that portion or portions of its periphery or circumference which would otherwise be contiguous or approximately so to the interior wall or bore of the second liner, as more fully described hereinafter. The fluid circulating tool also includes means for connecting the member to a drillstring, and generally cooperates with, and includes means for connecting thereto, a cementing tool assembly which comprises or includes means for transmitting a cement slurry to the bore of a liner. The fluid circulating tool connecting means are important in positioning the novel member in the enlarged wellbore initially, as described more fully hereinafter. As utilized hereinafter, the term "drillstring" is understood to include tool members or collars, etc., normally utilized in wellbore operations.

According to the invention, upon proper positioning of the liner-fluid circulating tool assembly of the invention, with an attached cementing tool in the enlarged wellbore, cement slurry is then pumped down the drillstring through the casing or first liner and the second liner (via the fluid circulating tool member, first fluid flow path) and into the enlarged wellbore annulus in an amount sufficient to cement the wellbore annulus. (Prior to cementing, other wellbore fluids may be present or used in the wellbore, as is common in the art, such as drilling fluid or spacer fluid.) The cement slurry displaces the wellbore fluid in the liner and the annulus formed by the liner wall and the enlarged wellbore, the wellbore fluid leaving the annulus through the ports and passages (second fluid flow path) mentioned previously.

In yet further embodiments, the invention relates to a novel liner assembly, and to a novel liner, fluid circulating tool combination. The liner assembly comprises a wellbore liner having a minor section of increased or expanded external and internal diameter communicating, preferably through a tapered or tapering section, with a larger major or remainder section of smaller external and internal diameter, the remainder portion provided with ports, and optional means for closing or sealing the ports, at a location proximate the junction of the sections. A further combination of the invention comprises the fluid circulating tool described.

BRIEF DESCRIPTION OF THE DRAWING

FIG. 1 illustrates schematically the prior art practice of telescoping liner sections.

FIG. 2 illustrates schematically a liner assembly according to the invention.

DETAILED DESCRIPTION OF THE INVENTION

Figure 3:
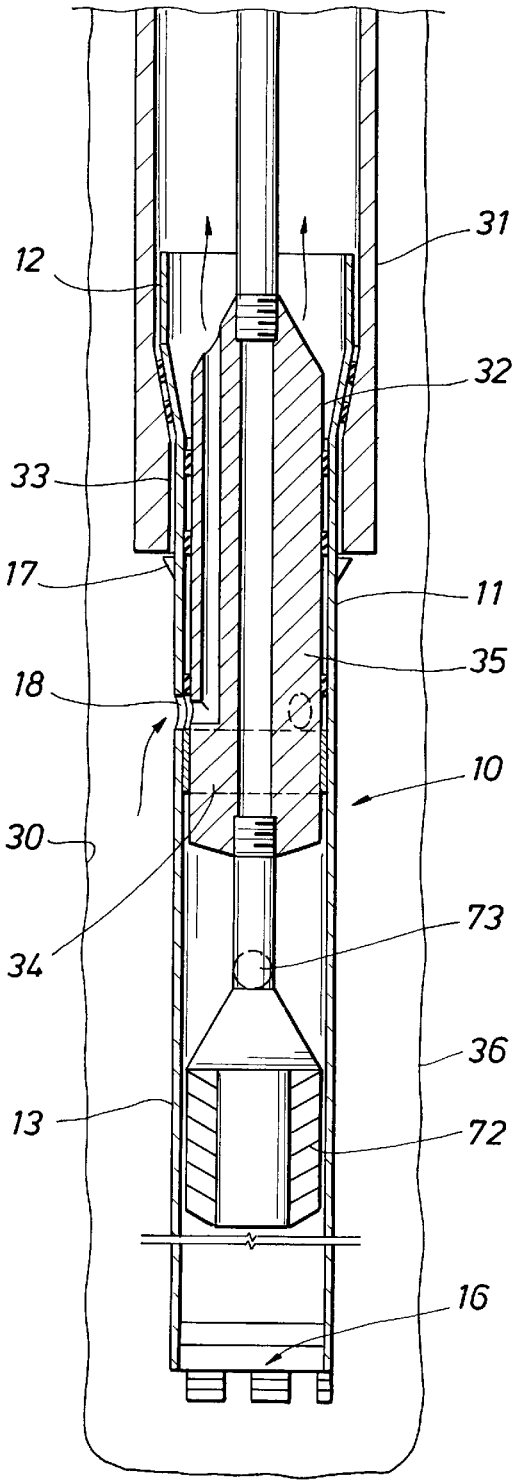
FIG. 3 illustrates schematically a preferred assembly adapted for a cementing operation in a wellbore.
Figure 4:
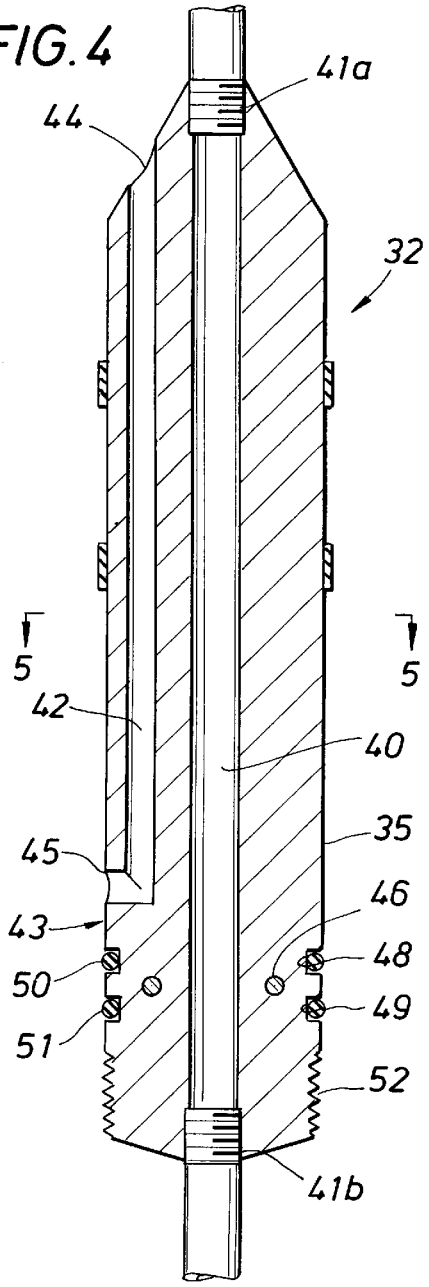
FIG. 4 is a vertical section of a novel fluid circulating tool according to the invention.

For a fuller understanding of the invention, reference is made to the drawing. Accordingly, in FIG. 1 there is shown a wellstring 1 extending to the earth surface 2 and to conductor pipe or casing 3. Conductor pipe 3 is positioned in the portion 4*a* of wellbore 4, while pipe 5 is in reduced diameter section 4*b* of the same wellbore. The wellbore forms segmented annulus 6 with pipes 3 and 5, the width of the annulus segments being the same or approximately the same. A further reduced diameter section 9 is illustrated. As is evident, standard cementing operations provide a cemented annulus which stabilizes the wellbore, but the effective diameter of the conducting passage is progressively and substantially reduced as the well is deepened.

FIG. 2 illustrates an important embodiment of the invention. Accordingly, in FIG. 2 there is shown a liner assembly designated generally as 10. The assembly includes the liner component 11 which, as shown, comprises a liner head section 12 which is integral with or coupled to and communicates with a main body portion or remainder segment 13. Head section 12 is larger in external and internal diameter than segment 13 (for understanding, the figure exaggerates the diameter size differential). Alternately, segment 13 may be conceived as having somewhat smaller or reduced external and internal diameter compared with segment 12. In a practical case, the external diameter of segment 12 may be larger than that of major segment 13 by a few millimeters or so, the internal diameters normally varying correspondingly. As will be understood by those skilled in the art, a "liner" or "casing" will be composed of segments or sections assembled and coupled by suitable means, such as by threaded connections. In the present invention, the major section 13 may be formed or composed of one section or less of liner, but will normally comprise many sections (each 30 ft.) to the end or bottom end thereof. As a practical matter, in providing the liner in the wellbore, all but the last section will be positioned in the wellbore, and the last section containing the larger diameter segment will be assembled with the fluid circulating tool, a cementing tool, and other operational structure for connection to the rest and lowering into the wellbore to the desired depth. In this embodiment, segments 12 and 13 are connected through an optional tapered segment or section 14. As illustrated, the segment 12 and tapered section 14 together form a generally frusto-conical liner shape whose smaller base would have a diameter corresponding to that of the major segment of liner 11. The angle of the taper may be varied considerably, but will preferably range from 1° to 25°, most preferably from 2° to 10°. The angle of taper is that angle formed by the juncture of a line in the interior surface of the taper extended to the axis of the major section, the angle of taper being at least substantially uniform around the tapered section for a particular segment utilized. In general, the angle of taper is determined by the weight of the liner to be supported and the characteristics of the section. However, head section 12 and section 13 may be connected by other equivalent joining means, such as by a reducing joint (not shown). An elastic or compressible sleeve (e.g., rubber) or sleeves 15 are provided at least in the tapered section 14 for centering and sealing, preferably also, as shown, in the head section 12. The liner assembly is further provided with means for preventing upward movement of the liner once positioned in place in the wellbore, such as locking keys or dogs 17, which are mounted on section 13 of the liner. The locking keys 17 secure the liner assembly from upward movement, e.g., from a sudden well eruption. The locking keys 17 are nested in or may trail liner 11 during insertion or lowering of the liner through the casing, and are mounted and actuated by suitable means described more fully hereinafter. Ports 18 are provided for entry of fluid from the wellbore, the ports being shown as closed by optional closure or sealing means, such as sliding or rotating sleeves, as illustrated or described more fully hereinafter. A slight cylindrical recess 19 (shown with dotted line) may be provided around the interior surface of the liner for accommodation of a sleeve or other sealing means, the recess extending upward for easier translation of the sleeve and allowing positioning of such means to provide alternate opening and obstruction or sealing of ports 18.

Liner segment 13 may be provided with suitable partial sealing means 16, such as a differential fill-up collar, and additional centering means (not shown), at or near the end of the liner opposite the minor section to allow ingress of fluid into the liner during insertion thereof in the enlarged wellbore, seal the liner from ingress of fluid from the wellbore after its insertion, and prevent egress of fluid from the bore of segment 13 (as described more fully hereinafter). As will be evident to those skilled in the art, the liner and cementing components or tool disposed therein may suitably be provided in or lowered into a well-bore as a unit, to the purpose that, upon completion of the cementing technique described more fully hereinafter, a suitable cemented liner combination of genuine advantage is obtained.

Figure 5:
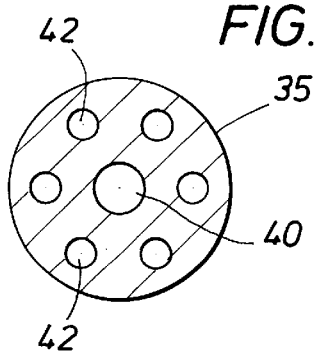
FIG. 5 is a horizontal section of a novel tool according to the invention.
Figure 6:
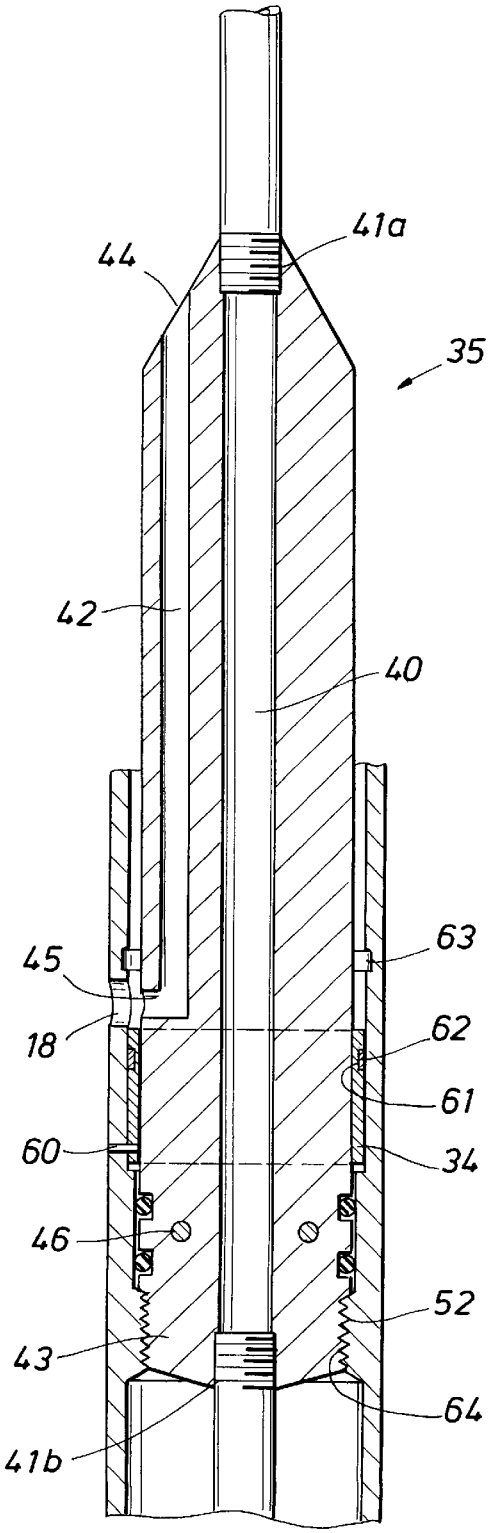
FIG. 6 illustrates a liner and tool assembly adapted for a cementing operation.
Figure 7:
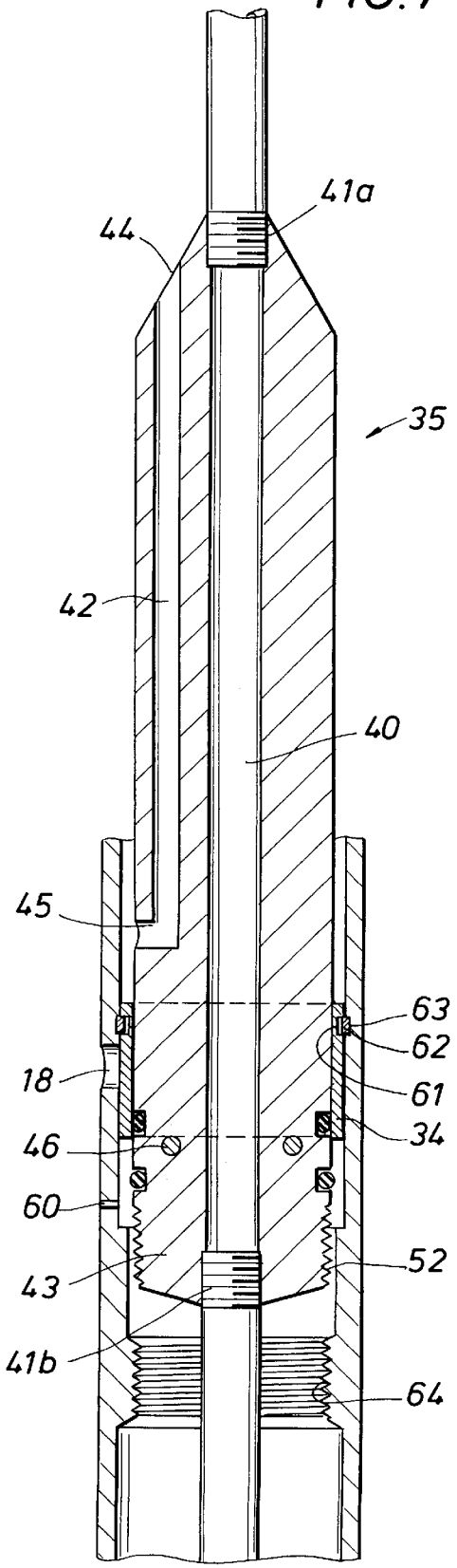
FIG. 7 illustrates the same assembly after completion of a cementing operation.

The procedure of the invention and operation of the novel apparatus of the invention are understood more fully by reference to FIGS. 3 through 7. Elements previously described with respect to FIGS. 1 and 2 are shown or referred to by identical numbers. Accordingly, in FIG. 3 the liner assembly 10 is provided in a wellbore 30, such as a hydrocarbon (e.g., oil or gas) wellbore, and positioned in relation to cemented casing 31, as shown. Liner assembly 10 is formed by first fitting together and lowering liner sections into the wellbore in normal fashion to form the greater length of the major section, and then, for example, fitting and coupling thereto a section comprising a minor portion of increased diameter and containing the novel components of the invention, as hereinafter described. The completed liner is then lowered into the wellbore and positioned, as shown, by means of a novel fluid circulating tool 32. Wellbore 30 has a diameter greater than the external diameter of casing 31, such wellbores being obtainable by use of a bi-center bit, under-reamer bit, or similar tool known to those skilled in the art. The external diameter of liner segment 12 is preferably just slightly smaller than the internal or, preferably, the drift, diameter of casing 31, being just sufficiently smaller to allow translation thereof through casing 31. The section 12 is shown as positioned and the tapered section 14 nested at the area of reduced internal diameter 33 of the casing or liner 31 (or joint) so that liner 10 cannot be lowered further into the wellbore. Means 17, such as the locking keys mentioned, are utilized to lock the liner 10 and prevent upward movement thereof. The locking keys 17 are preferably mounted on pins in recesses in liner 11 in known fashion, e.g., as commonly employed in tubing locators, and are spring biased to provide outward movement from the liner when clearance of section 33 is obtained. In FIG. 3, ports 18 are shown as open. A sliding sleeve 34 is provided, for closing of the ports 18, by suitable mechanism, as described more fully hereinafter. A slight cylindrical recess (not shown) is provided around the interior surface of the liner for accommodation of sleeve 34, the recess extending upward for easier translation of the sleeve and allowing the positioning of sleeve 34 to provide alternate opening and obstruction of ports 18. Additional detail of liner 11 is illustrated in FIGS. 6 and 7.

Fluid circulating tool 32 comprises tool member or body 35 which provides means for lowering the liner into a wellbore, for allowing the removal of fluid from the wellbore annulus 36 to permit cementing of the annulus, and for stabilizing the liner during cementing. Referring to FIGS. 4 through 7, which illustrate aspects of tool member 35 and its use and assembly with liner 11 in greater detail, body member 35 has a principal, preferably central, bore or passage 40 and has means, such as threads 41*a* and 41*b*, or equivalents thereof, for positioning or suspending the body member on a drillstring and for supporting a tool, respectively. Member 35 also possesses one or more passages or channels 42, preferably radially disposed from the central bore, to allow passage of fluid from the end 43 of member 35 to and through the end 44 of the member. FIG. 5 illustrates a preferred cross section of member 35, channel 40 being centered and the channels 42 being positioned or spaced radially around the tool member so as to provide communication with the ports 18 when the ports are unsealed. Each channel 42 terminates at its end 45 in such manner that good communication may be made with ports 18. Other channel configurations (not shown) may be employed, e.g., passage 40 may comprise more than one channel, and channels 42 may be irregularly spaced. Shear pins 46, whose purpose is described more fully hereinafter, are provided appropriately positioned at the lower end of tool member 35. Additionally, grooves 48 and 49, which contain o-ring sealing members 50 and 51, respectively, are provided in the lower section 43, as shown, for providing an effective seal between the outer surface of the tool member and the inner surface of the liner 11. Seals 50 and 51, together with the positioning of channel 40 and channels ensure separate flow passages for fluids into liner segment 13 and from enlarged borehole 36 back into the liner or casing. Means 52, such as right hand threads, or other suitable means, are provided for connecting the tool member 35 to a liner, to the end that proper support may be provided when the liner is being lowered into a wellbore.

FIGS. 6 and 7 illustrate the combination of fluid circulating tool and liner assembly, to the purpose that an advantageous cementing arrangement and procedure are provided. More particularly, as shown in FIG. 6, tool member 35 is positioned so that the end 45 of channel 42 communicates with ports 18 of liner 11. The sliding sleeve 34 comprises a cylindrical member slidably disposed in liner 11. Sleeve 34 is slidable between a lower open position, illustrated in FIG. 6, whereby the ports 18 are uncovered and an upper closed position shown in FIG. 7. At least one shear pin 60, or other similar shear means, is provided between liner 11 and sliding sleeve 34 for holding the sliding sleeve in the lower open port position until closing of ports 18 is desired, as described hereinafter. The sliding sleeve 34 further comprises a continuous annular groove 61 formed in the external surface thereof. An expandable locking ring 62 is disposed in the groove, as shown. A circular groove 63, which is of size and shape complimentary to the ring 62, is formed in the inner surface of liner 11, and is positioned with respect to ring 62 so that when shear pin 60 is sheared and sliding sleeve 34 is moved upward, the expandable locking ring 62 expands into the groove 63 and locks the sliding ring in position, blocking or sealing ports 18. If the interior surface of the liner has been recessed for assisting movement of sliding ring 34, the reduction in liner thickness will preferably extend to a point on the interior surface past groove 63. Sliding ring 34 may be provided with upward movement by upward movement of the tool member 35 and the action of shear pins 46 which force the ring upward when tool member 35 is moved upward in the wellbore. FIG. 7 illustrates this arrangement of the assembly in which ports 18 are blocked or sealed by upward repositioning of sliding sleeve 34. As will be apparent to those skilled in the art, shear pins 46 must have greater shear resistance than pin or pins 60. Liner 11 is provided with threads 64, as indicated, for cooperation with threads 52 to permit lowering of the liner into the wellbore and for securing the liner during cementing operations. The end portion 43 of member 35 is thus adapted to or provided with suitable structure to provide closed channels for fluid entering from ports 18, when the ends of channel 42 are positioned proximate the ports 18 and the sleeve 34 is appropriately positioned. The invention thus allows a cementing operation to be conducted which provides the advantages mentioned. More particularly, with the liner assembly, with cementing operation components, positioned in the enlarged wellbore, as shown, fluids, e.g., drilling mud or cement slurry, may be passed down the string 1 and via the pipe or bore 40 into the liner segment 13 or suitable tools or structure therein, described more fully hereinafter, out of the liner segment 13, and into the wellbore annulus 36. A preferred cementing assembly 72 (FIG. 3) includes suitable mounting means or connecting means 73, such as a threaded connector section for connecting to the tool member 35, as well as other cementing operation components, indicated generally, such as wiper plug launching apparatus, as described, for example, in U.S. Ser. No. 08/805,782, filed Feb. 25, 1997, now U.S. Pat. No. 5,890, 537, by Gilbert Lavaure, Jason Jonas, and Bernard Piot, incorporated herein by reference.

As previously mentioned, liner segment 13 is provided with suitable structure 16, at or near the end of the major segment of the liner, disposed from the tool member 35, to allow ingress of fluid from the wellbore, such as a displacement fluid, during insertion of the liner, and sealing of the liner from ingress of cement slurry after cementing. In the usual case, a differential fill-up collar will be employed at or near the bottom of the liner to prevent wellbore fluids from entering the liner, and any suitable such collar or similar device may be employed. A variety of such devices are described in Well Cementing, edited by E. I. Nelson, Schlumberger Educational Services (1990), and the selection of a particular device is well within the ambit of those skilled in the art. Additionally, in order to seal the bottom of the liner after the cement has been placed in the wellbore annulus, as more fully described hereinafter, suitable sealing means, known to those skilled in the art, may be provided. Preferably, the wiper plug system described in the aforementioned Serial No. 08/805782 may be employed, to the effect that a fluid tight seal is formed at the end of the liner distant from the assembly, or the bottom of the liner.

To conduct such a cementing operation, the liner, fluid circulating tool, and cementing components are assembled and positioned in the wellbore as shown in FIG. 6, ports 18 being open to allow wellbore fluids to pass through channel 42 and up the wellbore. Because of the novel invention configuration, hanger elements are not required. Following standard cementing procedures, cement slurry may be pumped downhole through the string 1 and through liner 11 via bore or pipe 40 through the cement flow distributor of tool 72, which may be that of the aforementioned wiper plug launching system, and out the bottom of the liner through open means 16. The cement slurry displaces the wellbore fluid and/or a suitable spacer fluid between the cement slurry and the fluid in the wellbore annulus, the wellbore fluid and/or spacer fluid passing from annulus 36 through open ports 18, channels 42, and into the bore of casing 31 without substantial impediment. The advantage of the internal flow removal of the annulus fluids according to the invention is demonstrated at this juncture. A wider cross section for production fluids can be achieved by the ability of the invention to remove fluids from the borehole annulus. Sealing means 16 at the bottom of liner section 13 is then sealed to the ingress and egress of fluid. In the normal case, after cement slurry sufficient to fill annulus 36 has been sent into the annulus, a wiper plug, which is solid, is sent downhole from the plug launching mechanism of assembly 72 to seal, with the differential fillup collar, the bottom of liner 11. As mentioned, the technique of the aforementioned Ser. No. 08/805782 is preferred. Ports 18 may then be closed by raising sliding ring 34. To raise sliding ring 34, the tool member 35 is first freed from liner 11 by unscrewing threads 52 so that the tool member 35 may be raised in the wellbore. When the tool member 35 is free, tool member 35 is raised in the wellbore, moving pins 46 upward. Movement of tool member 35 and pins 46 upward shears pin or pins 60 and forces sliding ring 34 upward to the position shown in FIG. 7, locking ring 62 in groove 63. The cement may then be allowed to set before removing tool 35 from the wellbore, or tool 35 may be removed immediately. To remove tool 35, the tool is raised further by the running string, shearing pins 46. Sliding ring 34 remains in place because of the action of locking ring 62, blocking flow through ports 18. A stabilized wellbore, with increased flow capability over conventional liner sequence technique, is produced.

As will be evident to those skilled in the art, the invention allows the use of liners of decreased wall thickness and greater internal diameters, with their attendant advantages, while providing the stability derived from a cemented wellbore. This achievement is made possible by the novel combination of features of the invention, particularly the drilling of an enlarged wellbore, thus retaining the ability to cement the wellbore, provision of means to remove the wellbore fluids expeditiously.

While the invention has been described with reference to specific embodiments, it is understood that various modifications and embodiments will be suggested to those skilled in the art upon reading and understanding this disclosure. For example, if desired, in some cases, the sealing means may be omitted or not employed, the cement filling the enlarged annulus simply being allowed to set and seal the ports. In such case the exit channel(s) of the fluid circulation tool member still allow the wellbore fluids to be removed with the attendant advantages of the invention. The tool member is not restricted to the specific structures illustrated, and those skilled in the art may provide, if desired, suitable sealing means for the ports on the tool member. Similarly, if utilized, other means for sealing the ports than the sliding sleeve may be employed, if utilized. Accordingly, it is intended that all such modifications and embodiments be included within the invention and that the scope of the invention be limited only by the appended claims.

What is claimed is:

1. A method of cementing a wellbore comprising providing a casing in a wellbore;

drilling a segment of enlarged wellbore through said casing; providing in the casing a liner-tool assembly comprising a wellbore liner having ports for wellbore fluid flow, and a fluid circulating tool disposed in said liner, said liner-tool assembly adapted to provide a first fluid flow path for transmission of a fluid through the fluid circulating tool and liner and into a wellbore, and a second separate fluid flow path for transmitting fluid received from exterior the liner through the ports and through the fluid circulating tool in a direction opposite that of said first fluid flow path;

positioning the liner-tool assembly in the wellbore so that the ports are positioned proximate and beneath the casing in the enlarged wellbore;

pumping a cement slurry through the first fluid flow path of the liner assembly and into the enlarged wellbore annulus in an amount sufficient to cement said wellbore annulus while allowing wellbore fluid from the enlarged wellbore to pass through said ports into the second fluid flow path and into the casing;

and allowing the cement to set.

2. The method of claim 1 in which means for sealing the ports are provided in said assembly, and the ports are sealed with said means before the cement is allowed to set.

3. A method of cementing a wellbore comprising providing a liner in a wellbore;

drilling a segment of enlarged wellbore through said liner;

providing in the liner a liner-tool assembly comprising a second liner having ports for wellbore fluid flow, and a fluid circulating tool disposed in said second liner, said liner-tool assembly adapted to provide a first fluid flow path for transmission of a fluid through the fluid circulating tool and second liner and into a wellbore, and a second separate fluid flow path for transmitting fluid received from exterior the second liner through the ports and through the fluid circulating tool in a direction opposite that of said first fluid flow path;

positioning the liner-tool assembly in the wellbore so that the ports are positioned proximate and beneath the liner in the enlarged wellbore;

pumping a cement slurry through the first fluid flow path of the second liner and into the enlarged wellbore annulus in an amount sufficient to cement said wellbore annulus while allowing wellbore fluid from the enlarged wellbore to pass through said ports into the second fluid flow path and into the liner;

and allowing the cement to set.

4. The method of claim 3 in which means for sealing the ports are provided in said assembly, and the ports are sealed with said means before the cement is allowed to set.

5. A method of cementing a wellbore comprising providing a casing in a wellbore, said casing terminating in a joining section of decreased internal diameter;

drilling a segment of enlarged wellbore through said casing;

providing in the wellbore a liner-tool assembly comprising a) a major section of liner, having ports, the external diameter of the major section approximating the internal diameter of the joining section;

b) a minor section of liner having an external diameter larger than the internal diameter of the joining section, said minor section in communication with the major section;

c) a fluid circulating tool disposed in the major and minor sections of liner, said tool comprising a tool member having a plurality of channels, and adapted to provide, with the major section of liner, a first fluid flow path for transmission of a fluid into the major section, and a second separate fluid flow path for receiving and transmitting fluid from the ports;

positioning the liner-tool assembly so that the ports of the major section are beneath and proximate the joining section in the enlarged wellbore, and the minor section is disposed in the casing above the joining section;

pumping a cement slurry through the first fluid flow path into the major section of liner and into the enlarged wellbore annulus in an amount sufficient to cement said wellbore annulus while allowing wellbore fluid from the enlarged wellbore to pass through said ports into the second fluid flow path and into the casing;

and allowing the cement to set.

6. The method of claim 5 means for sealing the ports are provided in said assembly, and the ports are sealed with said means before the cement is allowed to set.

7. A method of cementing a wellbore comprising providing a cemented liner in a wellbore, said cemented liner terminating in a joining section of decreased internal diameter;

drilling a segment of enlarged wellbore through said cemented liner;

providing in the wellbore a liner-tool assembly comprising a) a major section of liner, having ports, the external diameter of the major section approximating the internal diameter of the joining section;

b) a minor section of liner having an external diameter larger than the internal diameter of the joining section, said minor section in communication with the major section;

c) a fluid circulating tool disposed in the major and minor sections of liner, said tool comprising a tool member having a plurality of channels, and adapted to provide, with the major section of liner, a first fluid flow path for transmission of a fluid into the major section, and a second separate fluid flow path for receiving and transmitting fluid from the ports;

positioning the liner-tool assembly so that the ports of the major section are beneath and proximate the joining section in the enlarged wellbore, and the minor section is disposed in the cemented liner above the joining section;

pumping a cement slurry through the first fluid flow path into the major section of liner and into the enlarged wellbore annulus in an amount sufficient to cement said wellbore annulus while allowing wellbore fluid from the enlarged wellbore to pass through said ports into the second fluid flow path and into the cemented liner;

and allowing the cement to set.

8. The method of claim 7 means for sealing the ports are provided in said assembly, and the ports are sealed with said means before the cement is allowed to set.

9. The method of claim 6 wherein the wellbore is that of a hydrocarbon well.

10. The method of claim 8 wherein the wellbore is that of a hydrocarbon well.

11. The method of claim 6 wherein the ports are sealed by a sliding sleeve.

12. The method of claim 5 wherein the ports are sealed by a sliding sleeve.

13. A liner-tool assembly comprising a) a wellbore liner having a minor section of increased external and internal diameter joined to and communicating with a larger major section of smaller external and internal diameter, the major section provided with ports proximate the junction of the major and minor sections;

b) a fluid circulating tool comprising a tool member at least partly disposed in the major and minor sections of liner having at least one channel providing a first fluid flow path for transmission of a fluid into the major section and at least one channel providing a second fluid flow path for receiving and transmitting fluid from the ports, without substantial or significant impediment, into or through the minor section of liner; and c) a cementing assembly disposed in the major section of the liner and connected to the tool member.

14. The method of claim 5 wherein the major and minor sections are joined through a tapered section.

15. The method of claim 9 wherein the major and minor sections are joined through a tapered section.

16. The method of claim 15 wherein the angle of taper of the tapered section ranges from 2 to 10 degrees.

17. The method of claim 10 wherein the major and minor sections are joined through a tapered section.

18. The method of claim 17 wherein the angle of taper of the tapered section ranges from 2 to 10 degrees.

19. The method of claim 14 wherein the angle of taper of the tapered section ranges from 2 to 10 degrees.

20. The method of claim 5 wherein the internal diameter of the minor section of the liner is larger than the internal diameter of the major section of the liners.

21. The method of claim 20 wherein the major and minor sections are joined through a tapered section.

22. The method of claim 21 wherein the angle of taper of the tapered section ranges from 2 to 10 degrees.

23. The method of claim 7 wherein the internal diameter of the minor section of the liner is larger than the internal diameter of the major section of the liner.

24. The method of claim 23 wherein the major and minor sections are joined through a tapered section.

25. The method of claim 24 wherein the angle of taper of the tapered section ranges from 2 to 10 degrees.

26. The liner-tool assembly of claim 13 comprising sealing means for sealing the ports.

27. The liner-tool assembly of claim 13 comprising means inside the liner for sealing the ports and means on the tool member for actuating the means for sealing the ports.

28. The liner-tool assembly of claim 13 comprising means for releasably joining the liner and the fluid circulating tool.

29. The liner-tool assembly of claim 27 in which the means for sealing the ports comprises a sliding sleeve.

30. The liner-tool assembly of claim 29 comprising means for releasably joining the liner and the fluid circulating tool.

* * * * *